US006992429B2

(12) United States Patent
Ishihara

(10) Patent No.: US 6,992,429 B2
(45) Date of Patent: Jan. 31, 2006

(54) LAMP FOR AN AUTOMOBILE

(75) Inventor: Yoshihisa Ishihara, Osaka (JP)

(73) Assignee: Nipro Corporation, Osaka (JP)

( * ) Notice: Subject to any disclaimer, the term of this patent is extended or adjusted under 35 U.S.C. 154(b) by 0 days.

(21) Appl. No.: 10/807,544

(22) Filed: Mar. 24, 2004

(65) Prior Publication Data

US 2004/0212287 A1 Oct. 28, 2004

(30) Foreign Application Priority Data

Mar. 25, 2003 (JP) ..... 2003-083541

(51) Int. Cl.
*F21V 19/00* (2006.01)
*H01J 5/48* (2006.01)

(52) U.S. Cl. ..... 313/318.05; 313/318.07; 313/318.09

(58) Field of Classification Search ..... 313/318.05, 313/318.07, 318.09, 318.1, 318.12; 362/211, 362/226, 249; 439/617, 611
See application file for complete search history.

(56) References Cited

U.S. PATENT DOCUMENTS

| | | | | |
|---|---|---|---|---|
| 4,603,278 | A | 7/1986 | Devir et al. | 313/318 |
| 4,724,353 | A | 2/1988 | Devir et al. | 313/318 |
| 4,752,710 | A | 6/1988 | Devir et al. | 313/318 |
| 4,837,479 | A | 6/1989 | Devir et al. | 313/318 |
| 4,979,082 | A | 12/1990 | Devir | 362/226 |
| 5,008,588 | A * | 4/1991 | Nakahara | 313/318.1 |
| 5,043,624 | A * | 8/1991 | Hirozumi et al. | 313/318.09 |
| 5,130,911 | A * | 7/1992 | Eisner, Sr. | 362/658 |
| 6,056,417 | A | 5/2000 | Cheng | 362/226 |
| 6,232,707 | B1 | 5/2001 | Ranish et al. | 313/318.01 |
| 6,628,054 | B1 * | 9/2003 | Busai et al. | 313/318.01 |
| 6,815,878 | B2 * | 11/2004 | Bryant | 313/318.01 |
| 2001/0013748 | A1 * | 8/2001 | Ishihara | 313/318.09 |

FOREIGN PATENT DOCUMENTS

| | | |
|---|---|---|
| JP | 6-84673 U | 12/1994 |
| JP | 9-55272 A | 2/1997 |
| JP | 10-199491 A | 7/1998 |
| JP | 10-241443 A | 9/1998 |
| JP | 11-250869 A | 9/1999 |
| JP | 2000-58006 A | 2/2000 |
| JP | 2001-237035 A | 8/2001 |

* cited by examiner

*Primary Examiner*—Ashok Patel
(74) *Attorney, Agent, or Firm*—Kubovcik & Kubovcik

(57) ABSTRACT

A lamp for an automobile includes a lamp (10) and a base portion (30) to which the lamp (10) is mounted, in which the lamp (10) includes: a bulb (20); lead wires (11) extending from a base of the bulb (20); and a pinch seal portion (22) formed in the base of the bulb (20) for fixing the lead wires (11), and the base portion (30) includes a resin adapter (40) having a pair of adapter half bodies (40A, 40B) adapted to be placed onto the pinch seal portion (22) from left and right side portions of the pinch seal portion (22) in a transverse direction and mounted on the pinch seal portion (22).

8 Claims, 10 Drawing Sheets

LAMP FOR AN AUTOMOBILE

BACKGROUND OF THE INVENTION

1. Field of the Invention

The present invention relates to a lamp for an automobile.

2. Description of the Related Art

Conventional lamps for automobiles include lamps disclosed in U.S. Pat. Nos. 6,232,707 and 6,056,417. The lamps for automobiles in each of these patents have substantially the same configuration, and therefore the lamp for an automobile disclosed in U.S. Pat. No. 6,056,417 will hereinafter be described as a typical example.

FIG. 10 is a perspective view of a lamp for an automobile disclosed in U.S. Pat. No. 6,056,417. As shown in the figure, this lamp includes a lamp 110, and a base portion 130 to which the lamp 110 is mounted.

The lamp 110 is designed such that pairs of lead wires 11 mounted to both ends of filaments 12 are charged with electricity to cause a current to flow through the filaments 12 to thereby emit light due to electrical resistance of the filaments 12. The filaments 12 are disposed within a generally spherical glass envelope 21 of a bulb 20, and an inactive gas is enclosed in the glass envelope 21. Intermediate portions of the lead wires 11 are fixed by a pinch seal portion 22 of the bulb 20, and the lead wires 11 extend downwardly from the pinch seal portion 22. An exhaust tube 13 is sealed at a central portion of the pinch seal portion 22. This exhaust tube 13 is a tube used to establish an inactive gas atmosphere in the glass envelope 21 and after establishing the inactive gas atmosphere, is subjected to melt sealing to close the tube.

The base portion 130 includes a resin adapter 140 and a fixing member 150.

The resin adapter 140 includes a lamp mounting portion 141 for mounting the pinch seal portion 22 of the lamp 110, and a portion 142 which forms a base cap when lead wires are folded around its external surface, with a fitting cavity 143 being formed vertically therein. The fitting cavity 143 is fitted with the pinch seal portion 22 of the lamp 110 to thereby allow the lamp 110 to be mounted in the resin adapter 140.

When the lamp 110 is mounted in the resin adapter 140, portions of the lead wires 11 extending downwardly from a lower end of the portion 142 are bent or folded upwardly so that the folded portions of the lead wires 11 extend along a lower surface of the resin adapter 140. These folded portions of the lead wires 11 become a base cap through which a current is supplied from the outside.

Peripheral portions of the portion 142 of the resin adapter 140 are fitted with the fixing member 150 to fix the folded portions of the lead wires 11 in order to prevent the folded portions from being shifted from the proper positions.

The lamp 110 is manufactured in accordance with the following procedure before being mounted in the resin adapter 140.

First of all, the lead wires 11 of the lamp 110 are folded outwardly at a position lower than that of the lower end of the pinch seal portion 22. Folding the lead wires 11 makes it possible to prevent the lead wires from being melted or burned in the later melt sealing procedure. Next, the inactive gas atmosphere is established inside the lamp 110 through the exhaust tube 13, and an opening portion of the exhaust tube 13 is then subjected to the melt sealing procedure for heating and melting of the opening portion. Finally, the folded lead wires 11 are unfolded and restored into the original straight wires.

The lamp 110 having the lead wires 11 unfolded into the original straight wires is mounted in the resin adapter 140 to thereby assemble the lamp for an automobile.

However, the conventional lamp for an automobile has the following problems (i) to (iii).

(i) Since the lead wires 11 are unfolded for restored into the original straight wires after being firstly folded, the unfolding of the lead wires 11 is insufficient in some cases. In a case where the unfolding of the lead wires 11 is insufficient, there is a fear that the lead wires 11 are bent during insertion of the lead wires 11 into fine insertion holes 141 of the resin adapter 140, and in the worst case, the lead wires 11 can not be inserted into the insertion holes 141 of the base portion 140.

(ii) The positions of the filaments 12 inside the lamp are defined by a distance from a reference surface using an upper end of the resin adapter 140 in the base portion 130 as a reference surface. If the filaments are shifted from their proper positions, then an adverse influence is exerted on an illuminating angle. However, in the conventional lamp for an automobile, when the lamp 110 is mounted in the resin adapter 140, the lamp is continued to be inserted into the insertion cavity 143 of the resin adapter 140 until an upper end of the resin adapter 140 comes in contact with the glass envelope 21 of the bulb 20 in order to be positioned. For this reason, if processing accuracy for the glass envelope 21 of the bulb 20 is poor, then a position shift occurs in the reference surface, the positions of the filaments 12 are shifted accordingly, and hence the lamp concerned becomes a defective product.

(iii) A distal end side of the folded portions of each of the lead wires is held between the fixing member 150 and the resin adapter 140, whereby the lamp 110 is fixed to the resin adapter 140. In other words, the lamp 110 is merely fixed to the resin adapter 140 only by fixed portions of the lead wires 11. Hence, a firm fixing means is not provided against a vertical position shift. As a result, the filaments 12 may be shifted from their proper positions, or the lamp 110 may move vertically in some cases.

SUMMARY OF THE INVENTION

In the light of the foregoing, the present invention has been made in order to solve the above-mentioned problems associated with the prior art, and it is, therefore, an object of the present invention to provide a lamp for an automobile in which it is possible to avoid lack of conformity so that when a base portion is mounted with a lamp and lead wires are bent or can not be inserted, it is possible to prevent the lamp from moving, and it is possible to prevent the positions of filaments from being shifted from the proper positions irrespective of processing accuracy of the glass envelope of the lamp, and as a result it is possible to prevent products from being inferior in quality.

According to a first aspect of the present invention, there is provided a lamp for an automobile including a lamp and a base portion in which the lamp is mounted, in which the lamp includes: a bulb; lead wires extending from a base of the bulb; and a pinch seal portion formed in the base of the bulb for fixing the lead wires, and the base portion includes: a resin adapter having a pair of adapter half bodies adapted to be put onto the pinch seal portion from left and right side portions of the pinch seal portion in a transverse direction for mounting on the pinch seal portion.

According to a second aspect of the present invention, in the lamp for an automobile according to the first aspect of the present invention, each of the adapter half bodies includes: a lamp mounting portion to which the lamp is mounted; and a portion which is intended to serve as a base cap (hereinafter sometimes referred to simply as the base cap portion), and a seal-portion-accommodating recessed portion for accommodating the pinch seal portion is formed in the lamp mounting portion, and a lead wire accommodating portion for accommodating the lead wires is formed in the base cap portion.

According to a third aspect of the present invention, the lamp for an automobile according to the second aspect of the present invention further includes: ribs formed on front and rear surfaces of the pinch seal portion so as to extend in a transverse direction on the front and rear surfaces of the pinch seal portion; and rib grooves adapted to be engageable with the ribs and formed on inner wall surfaces of the seal-portion-accommodating recessed portion in each of the adapter half bodies so as to extend in a transverse direction of the inner wall surfaces of the seal-portion-accommodating recessed portion.

According to a fourth aspect of the present invention, the lamp for an automobile according to the third aspect of the present invention further includes holding portions having a saw-tooth structure in which peak portions and valley portions each extending in a transverse direction of inner wall surfaces of the seal-portion-accommodating recessed portion are alternately vertically formed, the holding portions being formed on the inner wall surfaces of the seal-portion-accommodating recessed portion in each of the adapter half bodies.

According to a fifth aspect of the present invention, the lamp for an automobile according to the second aspect of the present invention further includes: a lead wire fixing groove into which a portion of the lead wire accommodated in the lead wire accommodating portion is fitted, the portion being folded at a lower end of the base cap portion, the lead wire fixing groove being formed in the lower end of the base cap portion; and a tip fixing groove into which a tip of the lead wire is fitted, the tip fixing groove being formed in an upper portion with respect to the lead wire fixing groove in an external wall of the base cap portion.

According to a sixth aspect of the present invention, the lamp for an automobile according to the first aspect of the present invention further includes fixing means for fixing the pair of adapter half bodies in a state in which the pair of adapter half bodies are mounted on the pinch seal portion.

According to a seventh aspect of the present invention, in the lamp for an automobile according to the sixth aspect of the present invention, the fixing means includes a ring-like fixing member in which a fitting hole is formed into which peripheral portions of the pair of adapter half bodies in a joining state are fitted.

According to an eighth aspect of the present invention, in the lamp for an automobile according to the sixth aspect of the present invention, the fixing means includes: engagement projections provided on one of the pair of adapter half bodies; and engagement members provided in the other of the pair of adapter half bodies adapted to be engageable with the engagement projections.

DESCRIPTION OF THE PREFERRED EMBODIMENTS

Preferred embodiments of the present invention will hereinafter be described in detail with reference to the accompanying drawings.

Figure 1:
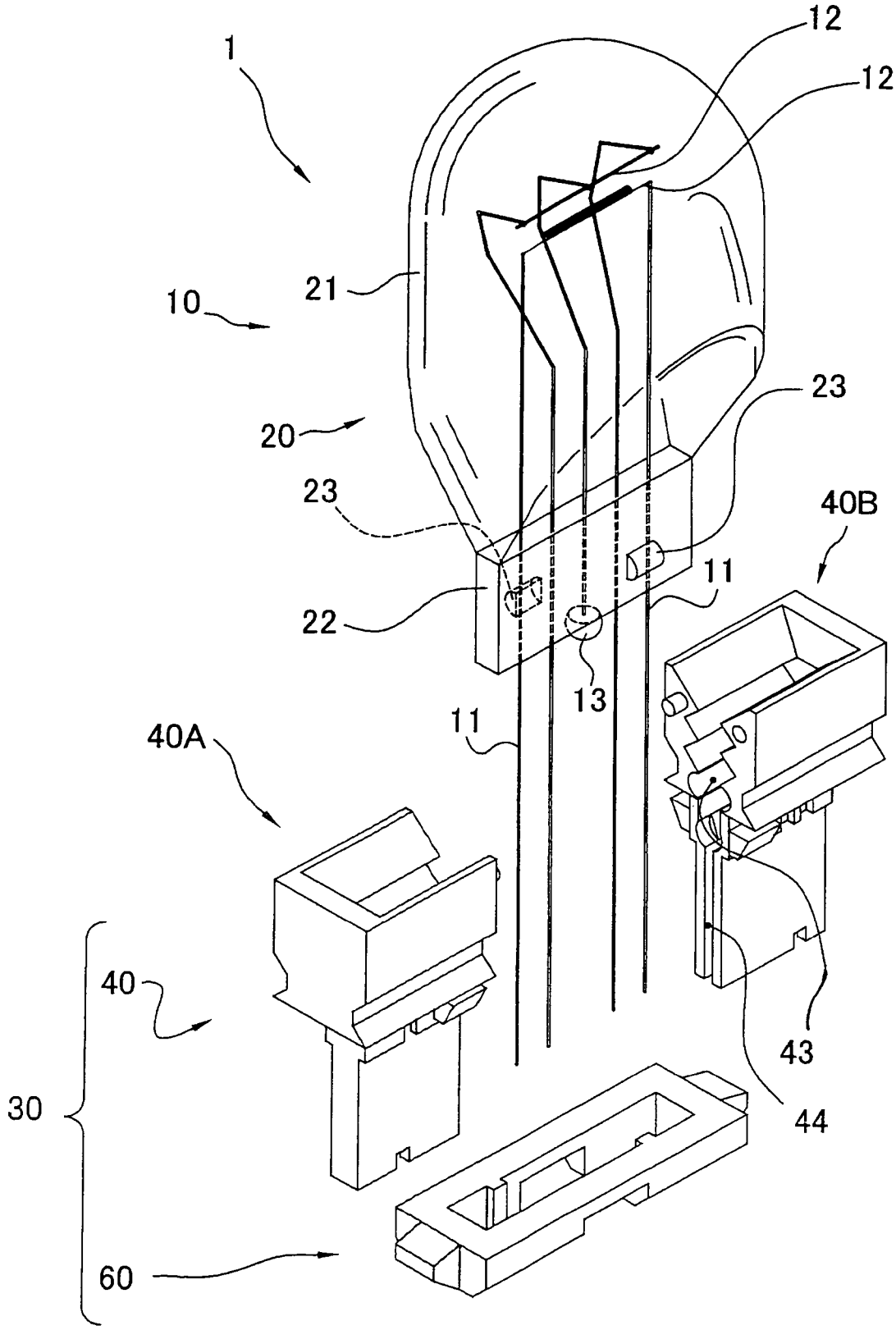
FIG. 1 is an exploded perspective view of a lamp for an automobile according to an embodiment of the present invention.
Figure 2:
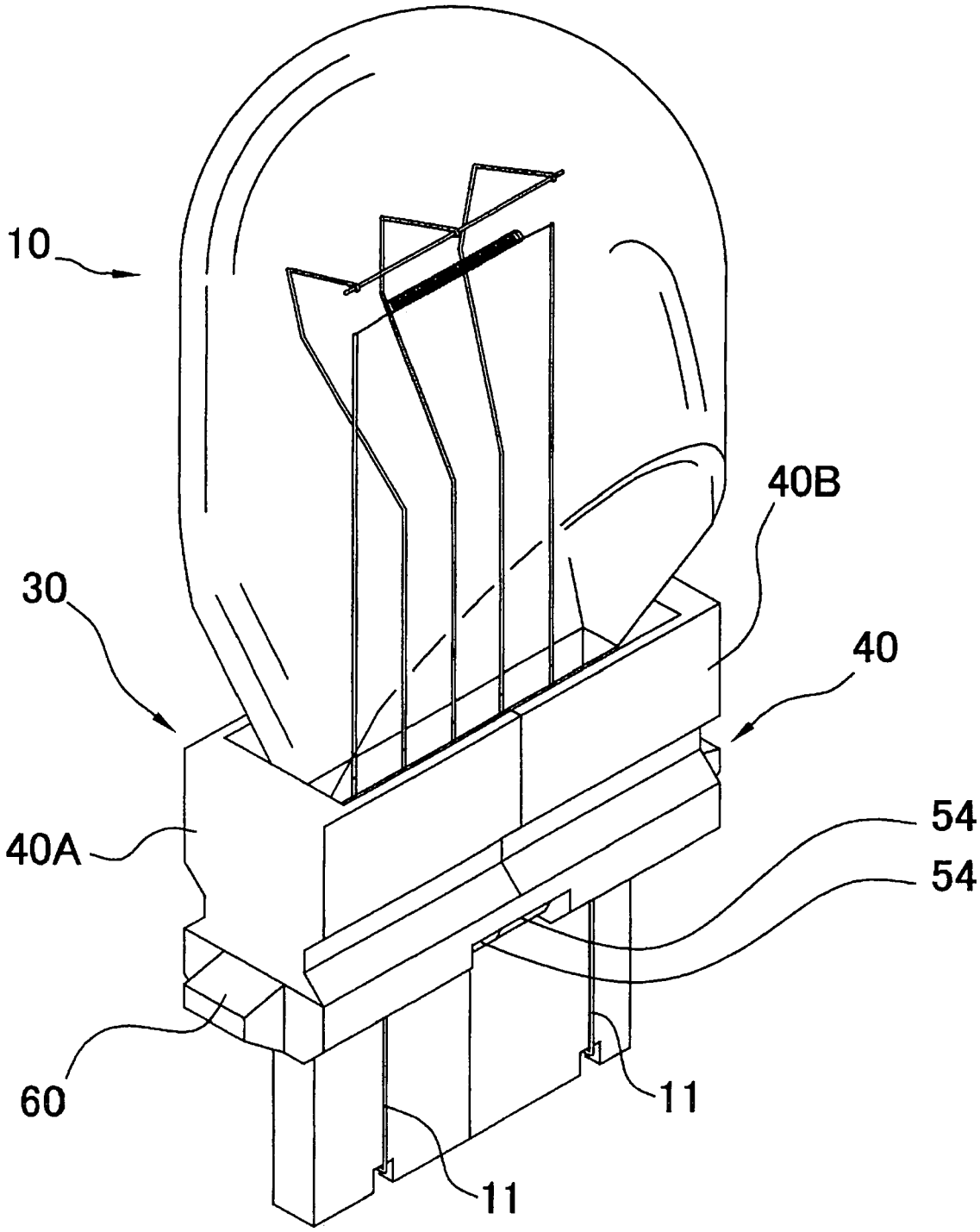
FIG. 2 is a schematic perspective view of the lamp for an automobile according to the embodiment of the present invention.

FIG. 1 is an exploded perspective view of a lamp for an automobile according to an embodiment of the present invention. FIG. 2 is a schematic perspective view of the lamp for an automobile according to an embodiment of the present invention. As shown in FIGS. 1 and 2, a lamp 1 for an automobile includes a lamp 10, and a base portion 30 in which the lamp 10 is mounted.

First, the lamp 10 will hereinafter be described.

Figure 3A:
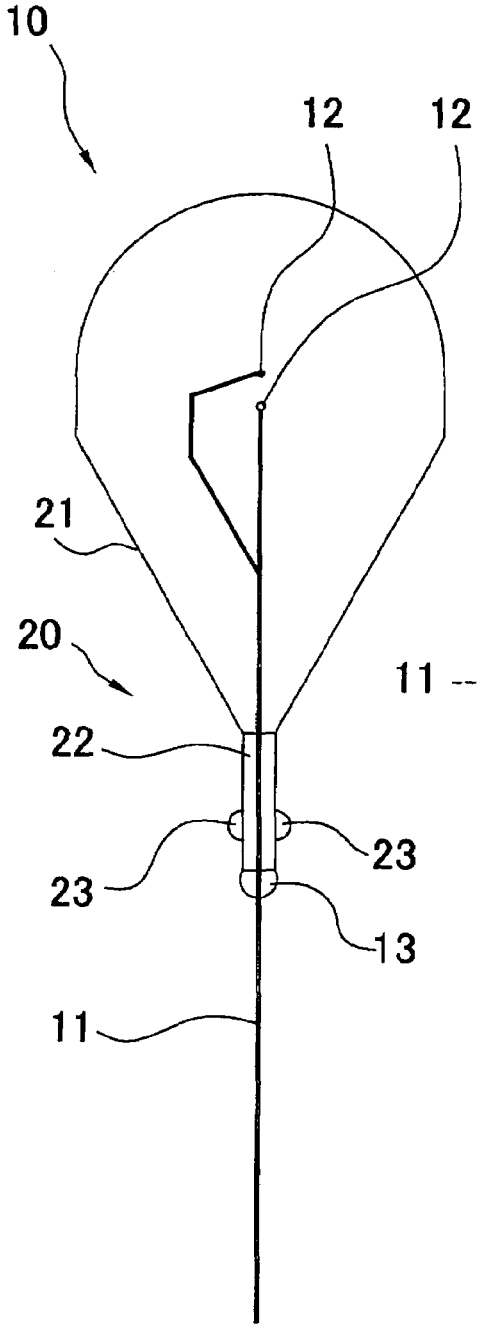
FIGS. 3(*a*) and 3(*b*) are a side elevational view of a lamp and a front elevational view of the lamp.
Figure 3B:
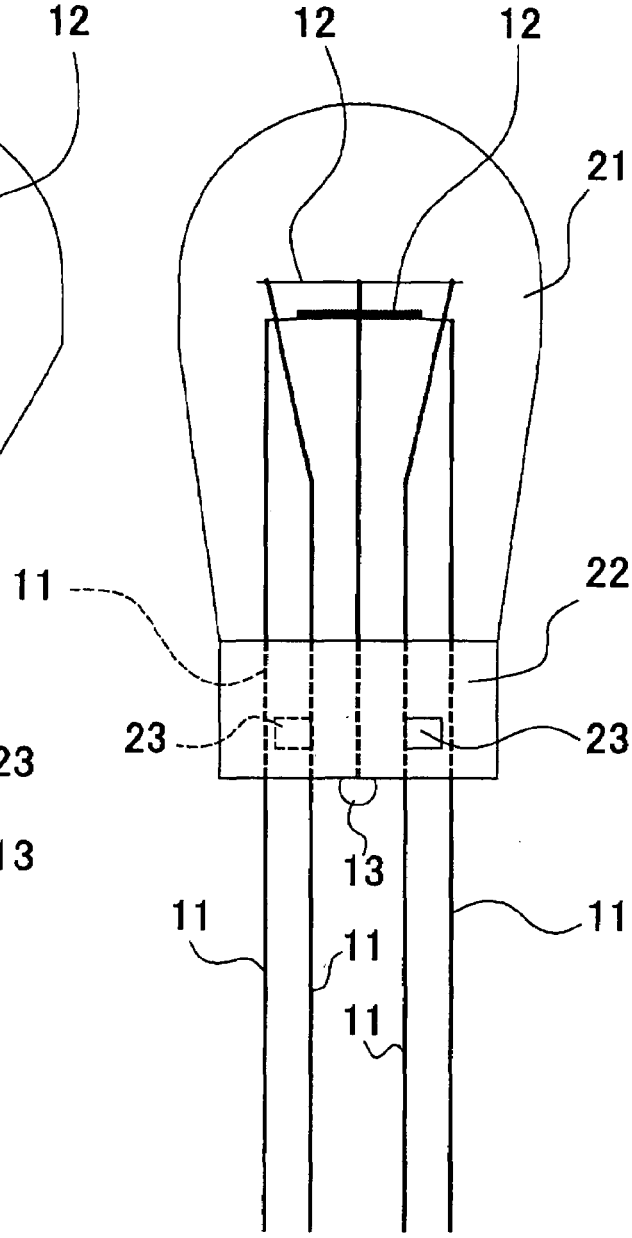

FIGS. 3(*a*) and 3(*b*) are a side elevational view and a front elevational view of the lamp 10. As shown in these figures, the lamp 10 is designed such that when a pair of lead wires 11 attached to both ends of a filament 12 is charged with electricity, a current is caused to flow through the filament 12 to emit light due to electrical resistance of the filament 12.

Note that while in the figures, two sets of pairs of lead wires 11 are mounted to ends of two filaments 12, respectively, one set or three or more sets of pairs of lead wires 11 may also be adopted.

The above-mentioned filaments 12 are disposed within a glass enclosure 21 of a bulb 20. An inactive gas is enclosed in the glass enclosure 21. This bulb 20 is formed by sealing an opening end portion of a hemispherically closed glass tube. The sealed portion is called a pinch (or press) seal portion 22. The pinch seal portion 22 is formed in a base of the bulb 20.

Intermediate portions of the lead wires 11 are fixed by the pinch seal portion 22, and portions of the lead wires 11 beyond the intermediate portions extend downwardly from the pinch seal portion 22. A protrusion protruding from a lower end of the pinch seal portion 22 shows a lower end of an exhaust tube 13 after completion of a melt sealing procedure.

Ribs 23 are formed on the front surface and rear surface of the pinch seal portion 22, respectively. The ribs 23 are formed in order to prevent adapter half bodies 40A and 40B as will be described later from being vertically shifted from their proper positions. Each rib 23 is a rod-like projection having an elongated shape and is formed on the pinch seal portion 22 so as to extend in a transverse direction of the pinch seal portion 22 relative to the axis of the bulb. A pair of ribs 23 is desirably formed so as to have the same position or height on the seal portion.

Note that the width of each rib 23 is arbitrary, and each rib 23 has only to extend in a transverse direction of the pinch seal portion 22 and hence may be short or long.

Moreover, note that each rib 23 may be formed together with the pinch seal portion 22 when the glass tube is sealed, or may be formed after the pinch seal portion 22 is formed.

Next, the base portion 30 will hereinafter be described.

As shown in FIG. 1, this base portion 30 is a portion in which the above-mentioned lamp 10 is mounted, and is constituted by a resin adapter 40 and a fixing member 60.

Note that the fixing member 60 is an optional constituent element and hence may be omitted.

First of all, the resin adapter 40 will now be described.

As shown in FIGS. 1 and 2, the resin adapter 40 is composed of a pair of adapter half bodies 40A and 40B. Since the adapter half bodies 40A and 40B formed in pairs are substantially identical to each other, the adapter half body 40A is described here as a typical one.

Figures 4A, 4B, 4C, 4D, 4E, 4F:
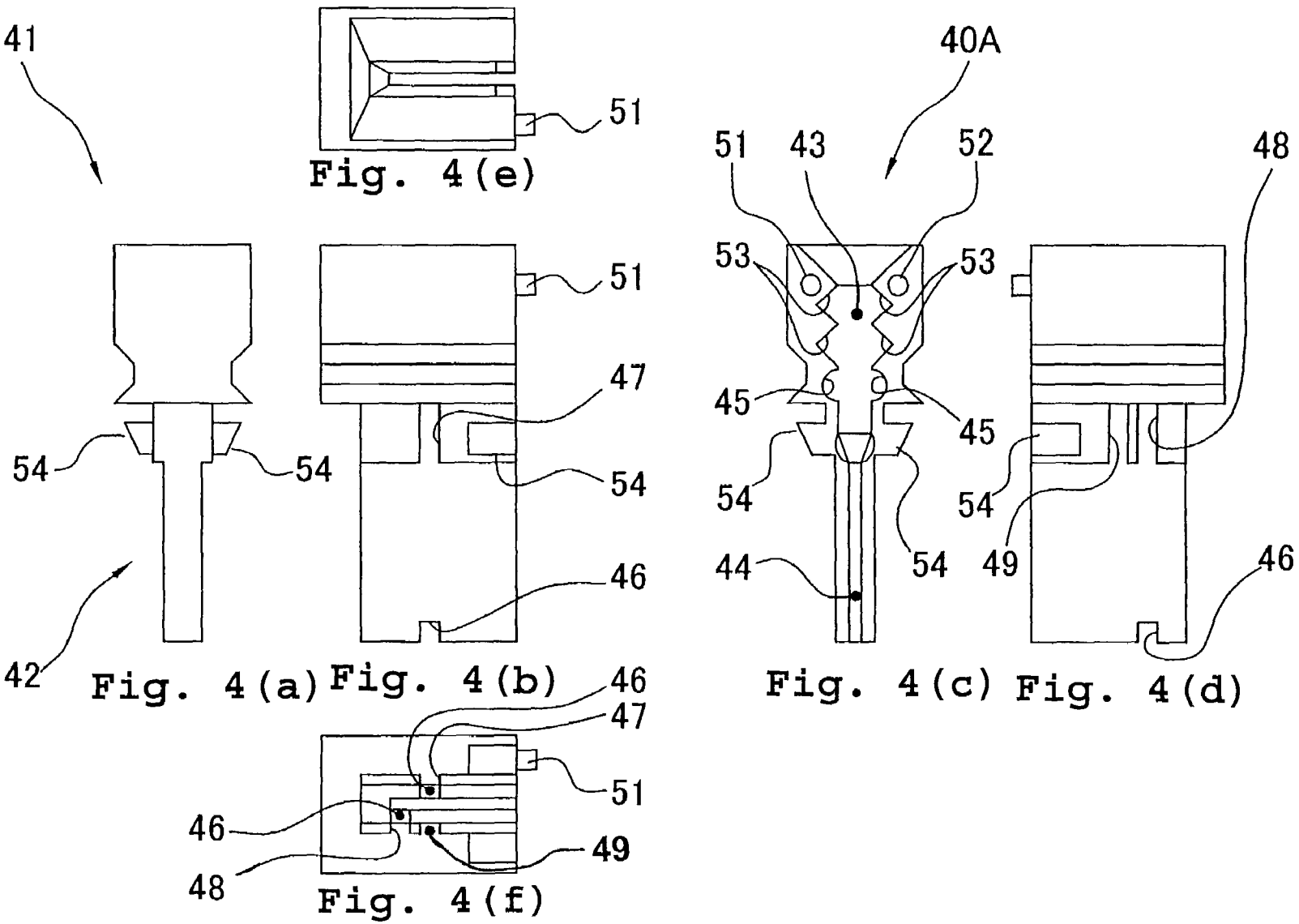
FIGS. 4(*a*) to 4(*f*) are a left side elevational view, a front elevational view, a right side elevational view, a rear elevational view, a plan view, and a bottom view of an adapter half body.

FIGS. 4(*a*) to 4(*f*) are a left side elevational view, a front elevational view, a right side elevational view, a rear elevational view, a plan view, and a bottom view of the adapter half body 40A. These figures are views of six surfaces of the adapter half body 40A. As shown in these figures, the adapter half body 40A is made of an insulating resin, and is constituted by a lamp mounting portion 41 and a portion 42 intended to serve as a base cap (hereinafter sometimes referred to as "a base cap portion").

The lamp mounting portion 41 is a portion in which the pinch seal portion 22 of the lamp 10 is to be mounted. A seal-portion-accommodating recessed portion 43 having a width slightly larger than a thickness of the pinch seal portion 22 is formed inside the lamp mounting portion 41.

The base cap portion 42 is a portion which is intended to become a base cap to which an electrical current is supplied from the outside. A lead wire accommodating portion 44 having a width larger than a diameter of each lead wire 11 is formed as a recess on an inside wall of the base cap portion 42.

Figure 6:
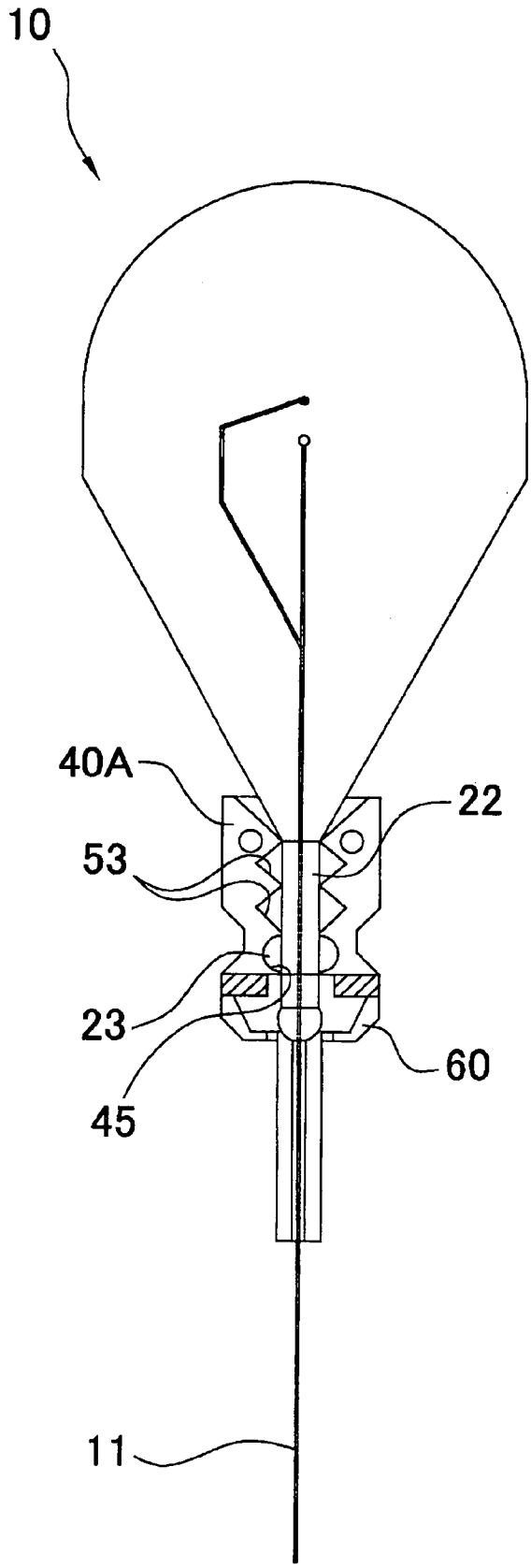
FIG. 6 is a side elevational view showing a state in which an adapter half body is mounted on the lamp.

FIG. 6 is a side elevational view showing a state in which the adapter half body 40A is mounted on the pinch seal portion 22 of the lamp 10. As shown in the figure, when the adapter half body 40A is mounted on the pinch seal portion 22, the pinch seal portion 22 can be accommodated in the seal-portion-accommodating recessed portion 43 of the lamp mounting portion 41, and also the lead wires 11 can be accommodated in the lead wire accommodating portion 44 of the base cap portion 42. Consequently, the adapter half body 40A can be put onto the pinch seal portion 22 of the lamp 10 in a transverse direction and mounted on the pinch seal portion 22 from either one of the left and right side portions of the pinch seal portion 22.

The adapter half body 40B can be mounted to the remaining half surface of the pinch seal portion 22 in a similar way.

When a pair of adapter half bodies 40A and 40B is put onto the pinch seal portion 22 from both the left and right side portions of the pinch seal portion 22 in the transverse direction and mounted on the pinch seal portion 22 as described above, the lead wires 11 can be inserted in the opening of the lead wire accommodating portions 44. For this reason, even if the unfolding of the lead wires 11 of the lamp 10 is insufficient, there is no fear that in accommodating the lead wires 11, the lead wires 11 will be hooked on the resin adapter. Thus, it is possible to remove such a problem that the lead wires 11 are bent or can not be inserted. As a result, it is possible to prevent a product from becoming inferior in its quality independently of the shape of each lead wire 11.

In the above-mentioned seal-portion-accommodating recessed portion 43, the rib grooves 45 which are adapted to be engaged with the ribs 23 and which extend in a transverse direction are formed in the wall surfaces facing each other, respectively.

When the adapter half body 40A is mounted on the pinch seal portion 22, a rib 23 formed in the pinch seal portion 22 of the lamp 10 is inserted into the rib groove 45 of the adapter half body 40A while being slid transversely, whereby the adapter half body 40A can be mounted to either the left or right half surfaces of the pinch seal portion 22 of the lamp 10.

The adapter half body 40B can be mounted on the remaining half surface of the pinch seal portion 22 in a similar way.

Since the ribs 23 of the pinch seal portion 22 are respectively engaged with the rib grooves 45 of a pair of adapter half bodies 40A and 40B, it is possible to prevent a pair of adapter half bodies 40A and 40B from being vertically shifted from their correct positions. As a result, it is possible to prevent the lamp 10 from moving.

Moreover, the pair of adapter half bodies 40A and 40B is not vertically shifted, even if the processing accuracy for the bulb 20 of the lamp 10 is poor, as long as the formation positions of the ribs 23 in the pinch seal portion 22 are accurately held, and distances between the filaments 12 and the reference surface of the resin adapter 40 can be held constant, and hence it is possible to prevent defective products from being manufactured.

In addition, in the seal-portion-accommodating recessed portion 43 of each of the adapter half bodies 40A and 40B, holding portions 53 are respectively formed in the front and rear inner wall portions facing each other. The holding portions 53 of each of the front and rear inner wall portions have a saw-tooth structure in which peak portions and valley portions each extending transversely are vertically and alternately formed.

The peak portions in the saw-tooth structure of the holding portions 53 are made of a resin such as, for example, polyethylene, nylon, choroethene, ABS resin and the like, and hence are soft. Thus, when the pinch seal portion 22 is put into the seal-portion-accommodating recessed portion 43, the peak portions of the holding portions 53 are deformed or sheared by the pinch seal portion 22. For this reason, even if the processing accuracy of the pinch seal in the pinch seal portion 22 varies so that the pinch seal portion 22 is more or less thickened, the pinch seal portion 22 can be put into the seal-portion-accommodating recessed portion 43.

Moreover, since the pinch seal portion 22 is inserted between a pair of front and rear holding portions 53 to be held between the holding portions 53, it is possible to prevent the pinch seal portion 22 from moving transversely.

As shown in FIGS. 4(*a*) to 4(*f*), a lead wire fixing groove 46 is formed in a lower end of the base cap portion 42 of the adapter half body 40A.

Figure 7:
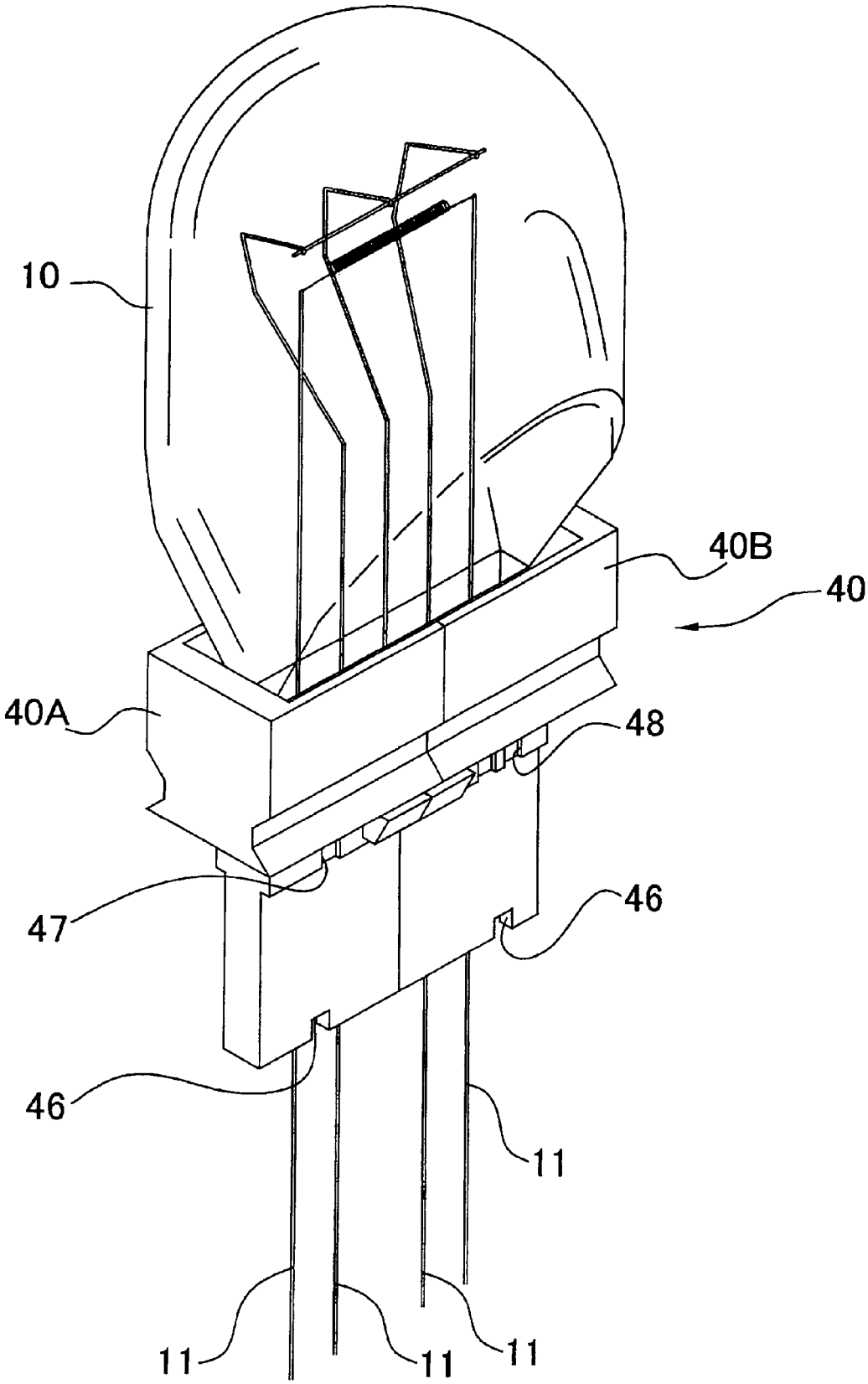
FIG. 7 is a schematic perspective view showing a state in which a pair of adapter half bodies mounted on the lamp.
Figure 8:
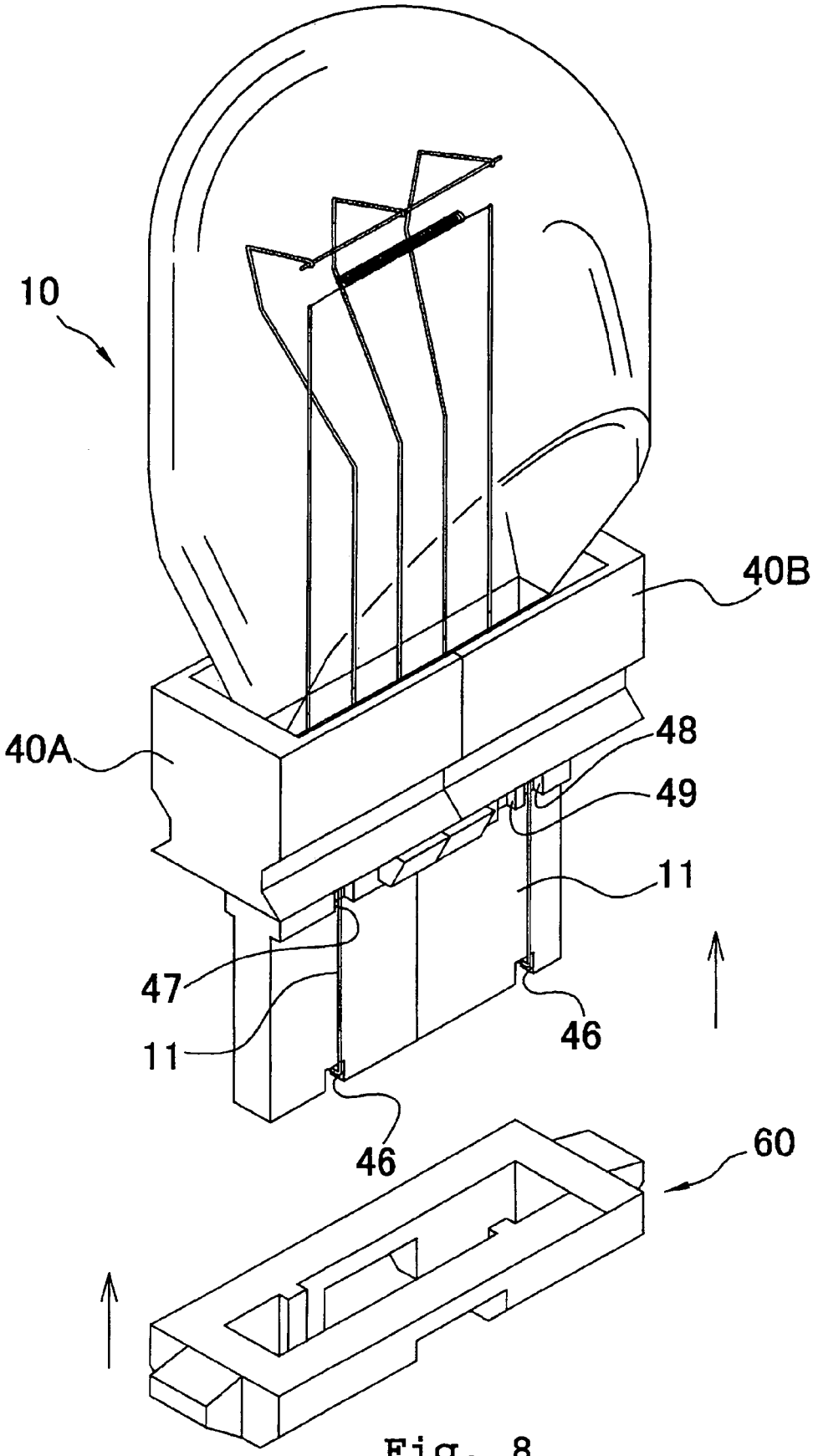
FIG. 8 is a schematic perspective view showing a state in which lead wires are folded at a lower end of a pair of adapter half bodies.

FIG. 7 is a schematic perspective view showing a state in which a pair of adapter half bodies 40A and 40B is mounted on the lamp 10. FIG. 8 is a schematic perspective view showing a state in which the lead wires 11 are folded at the lower ends of a pair of adapter half bodies 40A and 40B. As shown in FIGS. 7 and 8, when the lead wires 11 of the lamp 10 are folded at the lower end portion of the base cap portion 42 of the adapter half body 40A, the folded portions of the lead wires 11 can be fitted into the lead wire fixing grooves 46.

For this reason, due to formation of the lead wire fixing grooves 46, it is possible to prevent any of the lead wires 11 from sideslipping or sliding on the lower end portion of the cap intended portion 42.

As shown in FIGS. 4(*a*) to 4(*f*), tip fixing grooves 47 and 48 are respectively formed in the upper portion of the base cap portion with respect to the lead wire fixing grooves 46 in a surface and a rear face of an external wall of the base cap portion 42.

Thus, as shown in FIG. 8, since the tips of the lead wires 11 can be fitted into the tip fixing grooves 47 and 48, it is possible to prevent the tips of the lead wires 11 from being shifted from their proper positions.

Due to formation of the lead wire fixing grooves 46, and the tip fixing grooves 47 and 48, it is possible to prevent the lead wires 11 from being shifted from their predetermined positions.

As shown in FIGS. 4(*a*) to 4(*f*), a groove 49 is formed adjacent to the lead wire fixing grooves 48. This groove 49 is a groove for fixing a fixing member 60 as will be described later.

Also, a projection 51 and a hole 52 are respectively formed on left- and right-hand sides of the seal-portion-accommodating recessed portion 43 on a side end face of the adapter half body 40A. For this reason, when a pair of adapter half bodies 40A and 40B are mounted on the left- and right-hand sides of the pinch seal portion 22, their projections 51 are inserted into the corresponding holes 52, respectively, whereby the pair of adapter half bodies 40A and 40B can be joined to each other, and also a position shift can be prevented.

Next, the fixing member 60 will be described.

Figure 5A:
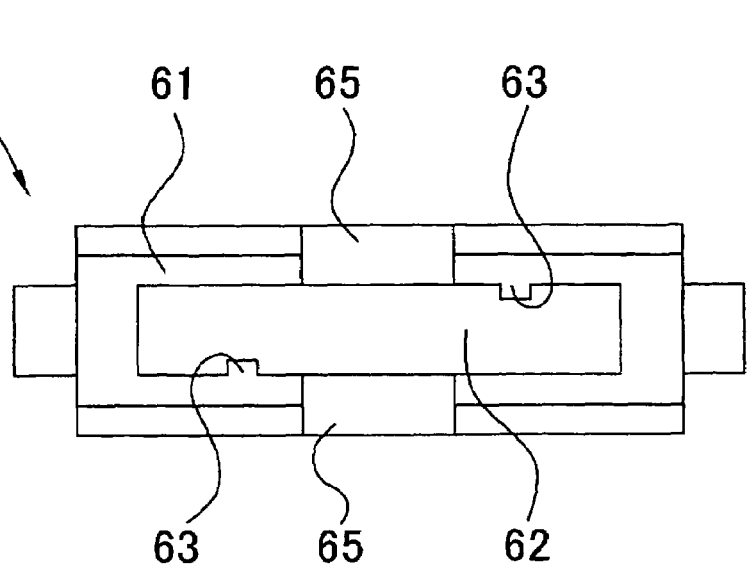
FIGS. 5(*a*) and 5(*b*) are a plan view and a front elevational view of a fixing member.
Figure 5B:
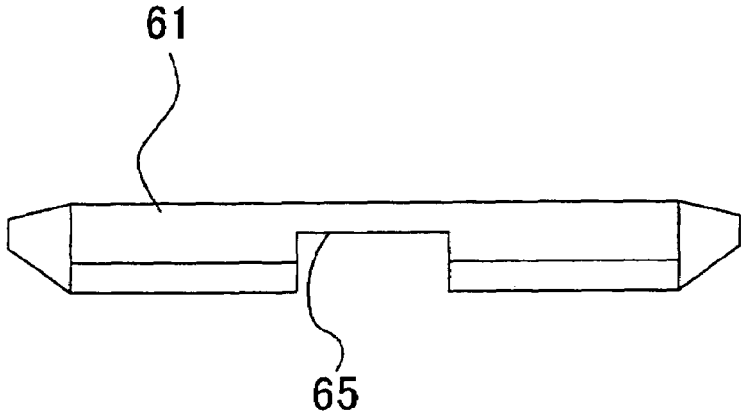

FIG. 5(*a*) is a plan view of the fixing member 60, and FIG. 5(*b*) is a front elevational view of the fixing member 60. As shown in FIGS. 5(*a*) and 5(*b*), the fixing member 60 has a ring-like shape. A fitting hole 62 is formed so as to vertically extend throughout a central portion of a member body 61 made of an insulating resin to thereby form the fixing member 60. The fitting hole 62 is a hole into which the peripheral portions of the base cap portions 42 in a state of a pair of adapter half bodies 40A and 40B being joined to each other are to be inserted.

For this reason, the peripheral portions of the base cap portions 42 of a pair of adapter half bodies 40A and 40B in the joined state are fixed within the fitting hole 62 of the fixing member 60 to thereby reliably fix a pair of adapter half bodies 40A and 40B in the joined state.

A portion 63 capable of being fitted into the groove 49 of the adapter half body 40A is formed in the fitting hole 62. Thus, when the base cap portions 42 are fitted with the fixing member 60, it is possible to prevent the fixing member 60 from being shifted leftward and rightward.

Figure 9:
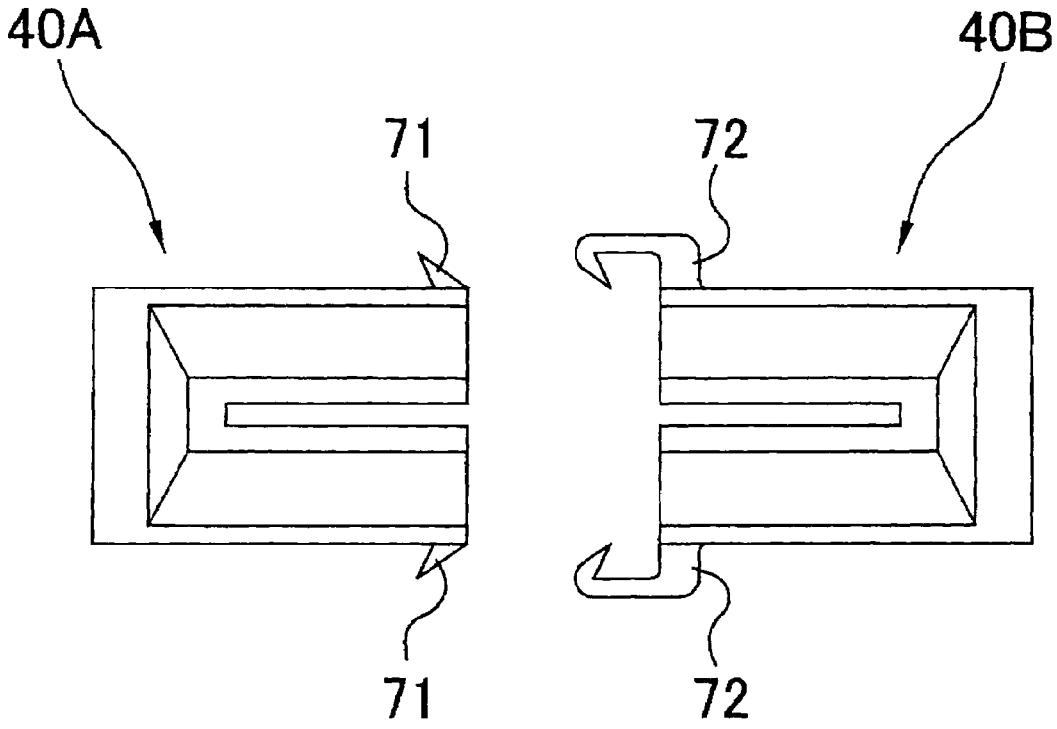
FIG. 9 is a plan view of a base portion according to another embodiment of the present invention.
Figure 10:
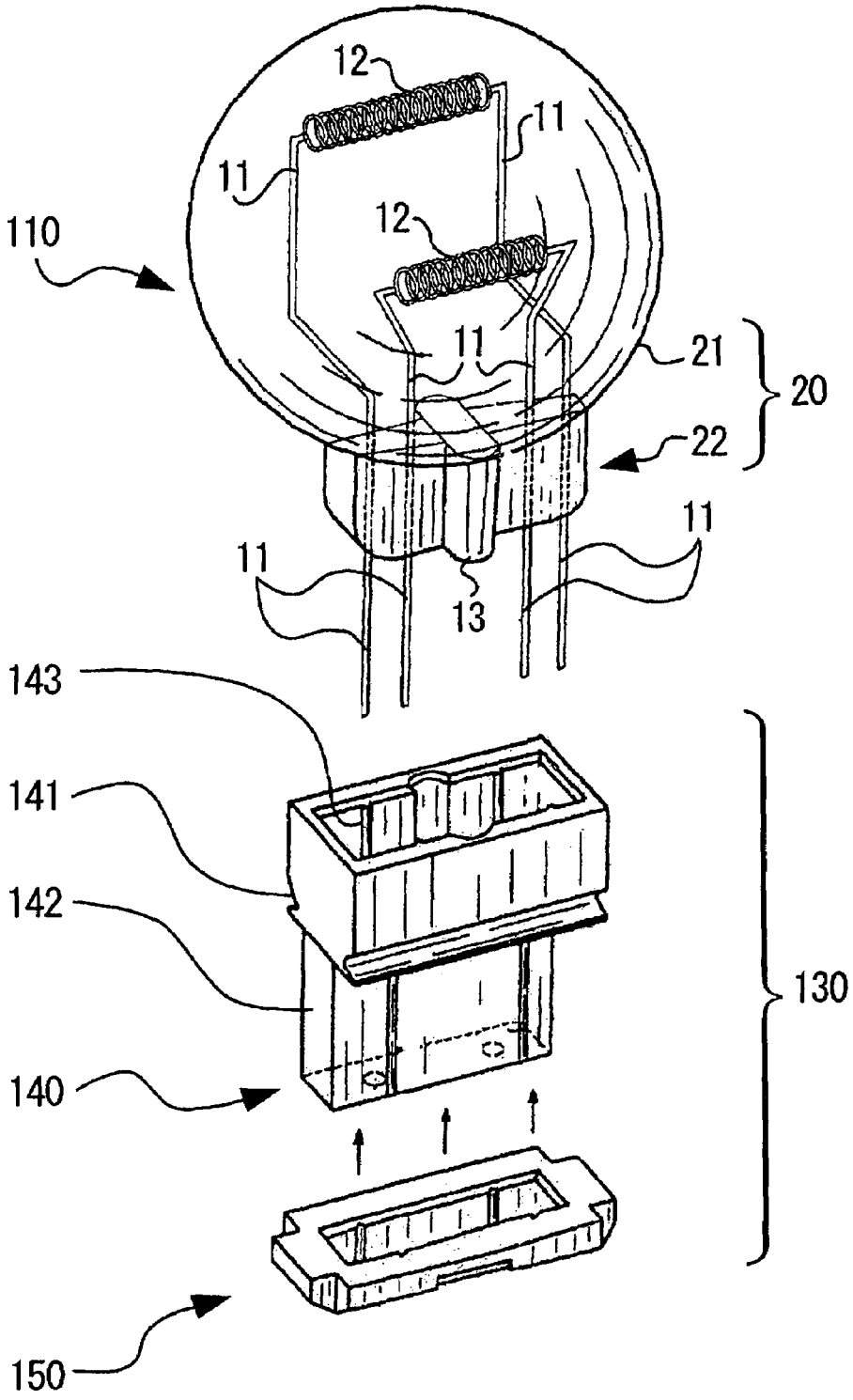
Prior Art Fig. 10
FIG. 10 is a schematic perspective view of a lamp for an automobile disclosed in U.S. Pat. No. 6,056,417.

FIG. 9 is a plan view of a base portion 30 according to another embodiment of the present invention. As shown in the figure, among the components of the base portion 30, a pair of adapter half bodies 40A and 40B is essential, but the above-mentioned fixing member 60 is merely optional. In a case where the base portion 30 is constituted by only a pair of adapter half bodies 40A and 40B, engagement projections 71 and engagement portions 72 have to be formed in the adapter half bodies 40A and 40B provided in pairs, respectively.

The engagement projections 71 can be projections which are formed on a surface and a rear surface of the joining portion in the adapter half body 40A, respectively.

The engagement portions 72 are pivotably mounted on a surface and a rear surface (opposite surfaces) of the joining portion in the adapter half body 40B, respectively, and their tips are provided with claws directed inwardly, respectively.

For this reason, when a pair of adapter half bodies 40A and 40B are joined to each other, the claws of the engagement portions 72 are engaged with the engagement projections 71, and the pair of adapter half bodies 40A and 40B can be simply fixed in the joined state.

Note that the fixing unit is not limited to the fixing member 60, or a combination of the engagement projections 71 and the engagement portions 72, and hence any unit may also be adopted as long as it is adapted to fix a pair of adapter half bodies 40A and 40B in a state in which the pair of adapter half bodies 40A and 40B is mounted on the pinch seal portion 22.

The lamp 1 for an automobile of this embodiment offers the following operations and effects (1) to (6).

(1) When a pair of adapter half bodies 40A and 40B is fitted onto the pinch seal portion 22 from the left- and right-hand side portions of the pinch seal portion 22 in a trans verse direction and mounted on the pinch seal portion 22, the lead wires 11 can be inserted through the opening of the lead wire accommodating portions 44. For this reason, even if unfolding of the lead wires 11 of the lamp 10 is insufficient, there is no fear that in accommodating the lead wires 11, the lead wires 11 are hooked or caught on the resin adapter. Thus, it is possible to prevent such problem that the lead wires 11 are bent or can not be inserted. As a result, it is possible to prevent a defective product from being manufactured independently of the shape of each lead wire 11.

(2) Since the rib grooves 45 of a pair of adapter half bodies 40A and 40B are engaged with the ribs 23 of the pinch seal portion 22, it is possible to prevent a pair of adapter half bodies 40A and 40B from being vertically shifted. As a result, it is possible to prevent the lamp 10 from moving.

(3) A pair of adapter half bodies 40A and 40B is not vertically shifted. Thus, even if the processing accuracy for the bulb 20 of the lamp 10 is poor, as long as the formation positions of the ribs 23 in the pinch seal portion 22 are accurately held, the distances between the filaments 12 and the reference surface of the resin adapter 40 can be held constant, and hence it is possible to prevent defective products from being manufactured.

(4) The holding portions 53 are respectively formed in the front and rear inner wall surfaces facing each other in the seal-portion-accommodating recessed portion 43 of each of the adapter half bodies 40A and 40B. The holding portions 53 formed in each of the front and rear inner wall surfaces have a saw-tooth structure in which peak portions and valley portions each extending transversely are alternately formed. The peak portions of the holding portions having the saw-tooth structure are made of a resin and hence are soft. Thus, when the pinch seal portion 22 is put into the seal-portion-accommodating recessed portion 43, the portions of the holding portions 53 are sheared or deformed by the pinch seal portion 22. For this reason, even if the processing accuracy for the pinch seal in the pinch seal portion 22 varies, and hence the pinch seal portion 22 is more or less thickened, the pinch seal portion 22 can be inserted into the seal-portion-accommodating recessed portion 43.

Moreover, since the pinch seal portion 22 is inserted to be held between a pair of front and rear hold portions 53, it is possible to prevent the pinch seal portion 22 from moving transversely.

(5) Portions of the lead wires 11 folded at the lower ends of the cap intended portions 42 can be fitted into lead wire fixing grooves 46, respectively. Hence, due to formation of the lead wire fixing grooves 46, it is possible to prevent the lead wires 11 from sideslipping on the lower end portions of the cap intended portions 42. Moreover, since the tips of the lead wires 11 can be fitted into the tip fixing grooves 47 and 48, it is possible to prevent the lead wires 11 from being shifted from their predetermined positions.

(6) The peripheral portions of a pair of adapter half bodies 40A and 40B in the joined state are fitted within the fitting hole 62 of the fixing member 60 to thereby enable a pair of adapter half bodies 40A and 40B to be simply fixed in the joined state.

According to the first aspect of the present invention, a pair of adapter half bodies can be fitted onto the pinch seal portion from the left- and right-hand side portions of the pinch seal portion in a transverse direction and mounted on the pinch seal portion. Hence, even if the unfolding of the lead wires of the lamp is insufficient, there is no fear that in accommodating the lead wires, the lead wires are hooked or caught. For this reason, it is possible to prevent lack of conformity that the lead wires are bent or can not be inserted. As a result, it is possible to prevent a defective product from being manufactured independently of a shape of each lead wire.

According to the second aspect of the present invention, when a pair of adapter half bodies is fitted onto the pinch seal portion from the left- and right-hand side portions of the pinch seal portion in a transverse direction and mounted on the pinch seal portion, the lead wires can be inserted through the opening of the lead wire accommodating portions. For this reason, even if the unfolding of the lead wires of the lamp is insufficient, there is no fear that in accommodating the lead wires, the lead wires are caught or hooked on the adapter.

According to the third aspect of the present invention, since the rib grooves of the adapter half bodies are engaged with the ribs of the pinch seal portion, it is possible to prevent the adapter half bodies from being vertically shifted. As a result, it is possible to prevent the lamp from moving. Moreover, since the adapter half bodies are not vertically shifted, even if the processing accuracy for the bulb of the lamp is poor, as long as the formation positions of the ribs in the pinch seal portion are accurately held, the distances between the filaments and the reference surface of the adapter half bodies can be held constant, and hence defective products can be prevented from being manufactured.

In addition, according to the fourth aspect of the present invention, since the peak portions of the holding portions having the saw-tooth structure are made of a resin and hence are soft, when the pinch seal portion is put into the seal-portion-accommodating recessed portion, the top portions of the holding portions are sheared off or deformed by the pinch seal portion. For this reason, even if the processing accuracy for the pinch seal in the pinch seal portion varies so that the pinch seal portion is more or less thickened, the pinch seal portion can be inserted into the seal-portion-accommodating recessed portion. Moreover, since the pinch seal portion is inserted to be held between a pair of front and rear holding portions, it is possible to prevent the pinch seal portion from moving transversely.

According to the fifth aspect of the present invention, since portions of the lead wires folded at the lower end of the cap intended portion can be fitted into the lead wire fixing grooves, respectively, due to formation of the lead wire fixing grooves, it is possible to prevent the lead wires from sideslipping on the lower end portion of the base cap portion. Moreover, since the tips of the lead wires can be fitted into the tip fixing grooves, it is possible to prevent the lead wires from being shifted from their predetermined positions.

According to the sixth aspect of the present invention, since the lead wires of the lamp can be put between the fixing member and the base cap portions of the adapter half bodies due to adoption of the fixing member, it is possible to reliably fix the lead wires.

Also, according to the seventh aspect of the present invention, the peripheral portions of a pair of adapter half bodies in the joined state are fitted within the fitting hole of the fixing member to thereby allow a pair of adapter half bodies to be reliably fixed in the joined state.

Moreover, according to the eighth aspect of the present invention, since when the adapter half bodies provided in pairs are joined to each other, engagement portions are engaged with engagement projections, a pair of adapter half bodies can be simply fixed in the joined state.

What is claimed is:

1. A lamp for an automobile comprising a lamp and a base portion to which the lamp is mounted, wherein:

the lamp comprises:

a bulb having a base;

lead wires attached to ends of a filament in the bulb and extending from the base of the bulb; and a pinch seal portion formed in the base of the bulb and fixing the lead wires; and the base portion comprises:

a resin adapter including a pair of adapter half bodies adapted to be fitted onto the pinch seal portion from left and right side portions of the pinch seal portion in a transverse direction and mounted on the pinch seal portion.

2. A lamp for an automobile according to claim 1, wherein:

each of the adapter half bodies comprises:

a lamp mounting portion in which the lamp is mounted; and a base cap portion for forming a base cap; and a recessed portion for accommodating the pinch seal portion and which is formed in the lamp mounting portion, and a lead wire accommodating portion for accommodating the lead wires and which is formed in the base cap portion.

3. A lamp for an automobile according to claim 2, further comprising:

a rib formed on each of front and rear surfaces of the pinch seal portion and extending in a transverse direction on said front and rear surfaces of the pinch seal portion; and rib grooves adapted to engage the ribs and formed on inner wall surfaces of the recessed portion in each of the adapter half bodies and extending in a transverse direction of the inner wall surfaces of the recessed portion.

4. A lamp for an automobile according to claim 3, further comprising holding portions for engaging said front and rear surfaces of the pinch seal portion, said holding portions having a saw-tooth structure in which peak portions and valley portions each extending in a transverse direction of inner wall surfaces of the recessed portion are formed, the holding portions being formed on the inner wall surfaces of the recessed portion in each of the adapter half bodies.

5. A lamp for an automobile according to claim 2, further comprising:

a lead wire fixing groove into which a portion of the lead wire accommodated in the lead wire accommodating portion is fitted, said portion of said lead wire being folded at a lower end of the base cap portion, the lead wire fixing groove being formed in a lower end surface of the base cap portion; and a tip fixing groove into which a tip of the lead wire is fitted, the tip fixing groove being formed in an upper portion of an external wall of the base cap portion with respect to the lead wire fixing groove.

6. A lamp for an automobile according to claim 1, further comprising fixing means for fixing the pair of adapter half bodies in a state in which the pair of adapter half bodies are mounted on the pinch seal portion.

7. A lamp for an automobile according to claim 6, wherein the fixing means comprises a ring-like fixing member in which a fitting hole is formed with which peripheral portions of the pair of adapter half bodies in a joined state are fitted.

8. A lamp for an automobile according to claim 6, wherein the fixing means comprises:

engagement projections provided in one of the pair of adapter half bodies; and engagement members provided in the other of the pair of adapter half bodies and adapted to engage the engagement projections.

* * * * *